US011297945B2

(12) United States Patent
Cattaneo

(10) Patent No.: US 11,297,945 B2
(45) Date of Patent: Apr. 12, 2022

(54) TELESCOPIC FOOT FOR FURNITURE AND/OR FURNISHING ITEMS WITH SIMPLIFIED ASSEMBLY AND SYSTEM USING SAID FOOT

(71) Applicant: Leonardo S.r.l., Figino Serenza (IT)

(72) Inventor: Carlo Cattaneo, Figino Serenza (IT)

( * ) Notice: Subject to any disclaimer, the term of this patent is extended or adjusted under 35 U.S.C. 154(b) by 0 days.

(21) Appl. No.: 17/275,400

(22) PCT Filed: Sep. 17, 2019

(86) PCT No.: PCT/IB2019/057797
§ 371 (c)(1),
(2) Date: Mar. 11, 2021

(87) PCT Pub. No.: WO2020/058831
PCT Pub. Date: Mar. 26, 2020

(65) Prior Publication Data

US 2022/0047078 A1 Feb. 17, 2022

(30) Foreign Application Priority Data

Sep. 19, 2018 (IT) ..... 102018000008723

(51) Int. Cl.
*A47B 91/02* (2006.01)
*A47B 91/00* (2006.01)

(52) U.S. Cl.
CPC ..... *A47B 91/028* (2013.01); *A47B 91/005* (2013.01)

(58) Field of Classification Search
CPC combination set(s) only.
See application file for complete search history.

(56) References Cited

U.S. PATENT DOCUMENTS 3,742,552 A * 7/1973 Balchunas ..... A47B 91/00 16/42 R
4,991,805 A * 2/1991 Solak ..... F16M 7/00 248/188.4
5,292,095 A * 3/1994 Cattaneo ..... A47B 91/028 248/188.4
5,967,472 A * 10/1999 Wilhelmstatter ... A47L 15/4253 248/188.4

(Continued)

FOREIGN PATENT DOCUMENTS

EP 0393473 10/1990
EP 1698253 9/2006

(Continued)

*Primary Examiner* — Monica E Millner
(74) *Attorney, Agent, or Firm* — Themis Law

(57) ABSTRACT

A telescopic foot for furniture and/or furnishing items includes a hollow body housing a supporting foot designed for telescopically sliding therein using an internal control or kinematic mechanism, which is actuated by a control transmission bevel gear positioned between a first actuation opening of the bevel gear and a second telescopically sliding opening of the supporting foot, both defined in the body of the foot, one laterally and the other one axially and in orthogonal positions to each other, so as to each receive an element of the bevel gear. Sliding elements enable the sliding of the supporting foot with respect to the body of the foot, and engagement and retention elements engage the supporting foot and the hollow body of the foot.

25 Claims, 15 Drawing Sheets

(56) References Cited

U.S. PATENT DOCUMENTS

| | | | | |
|---|---|---|---|---|
| 7,597,294 | B2 * | 10/2009 | Lotz | D06F 39/125 248/188.3 |
| 8,220,760 | B2 * | 7/2012 | Fetzer | A47L 15/4253 248/188.4 |
| 10,278,500 | B2 * | 5/2019 | De Bruin | A47B 91/024 |
| 10,638,839 | B2 * | 5/2020 | Cattaneo | A47B 91/028 |
| 10,962,037 | B2 * | 3/2021 | Cattaneo | F16B 12/2027 |
| 2007/0205342 | A1 * | 9/2007 | Gabriel | F16M 7/00 248/188.4 |
| 2018/0368574 | A1 * | 12/2018 | Cattaneo | A47B 91/028 |

FOREIGN PATENT DOCUMENTS

| | | |
|---|---|---|
| GB | 191002372 | 8/1910 |
| WO | 2005115199 | 12/2005 |

* cited by examiner 37
35
33
30
31
32
20
41

54
29
39
28
27
23
26
21
24
22
14
25

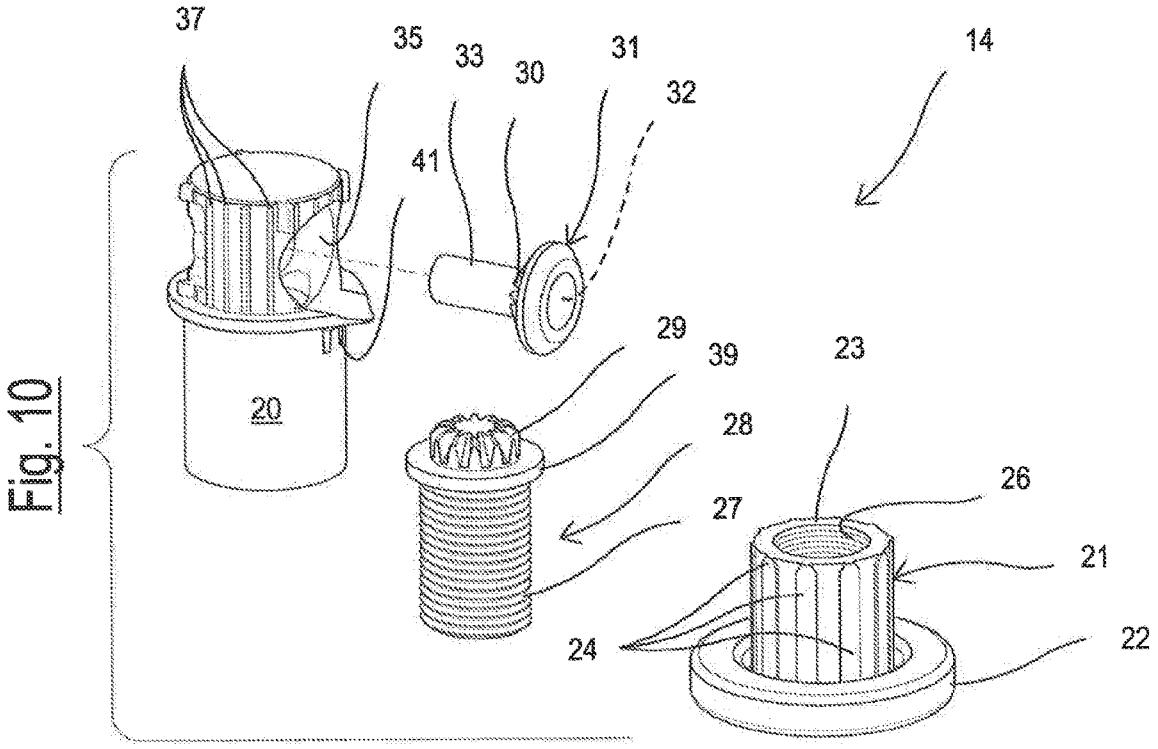
Fig. 10
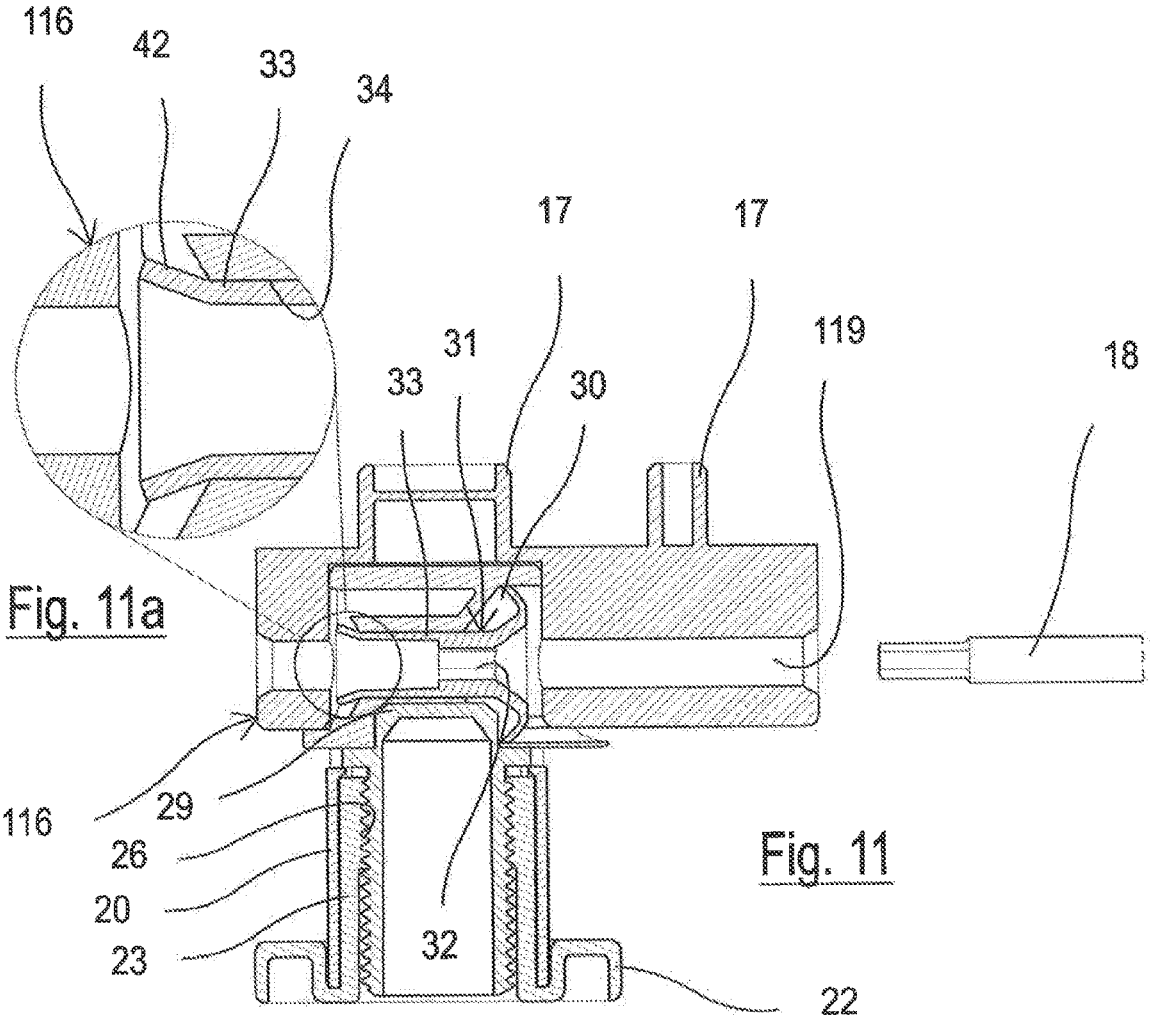
Fig. 11a
Fig. 11

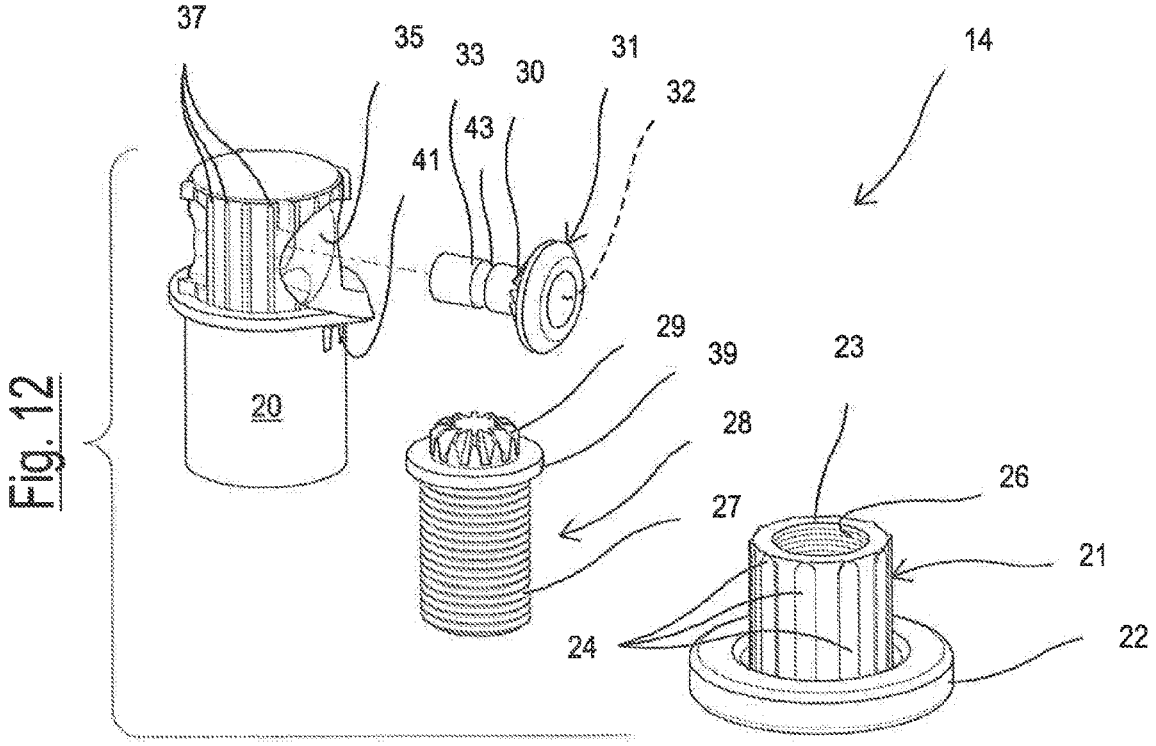
Fig. 12
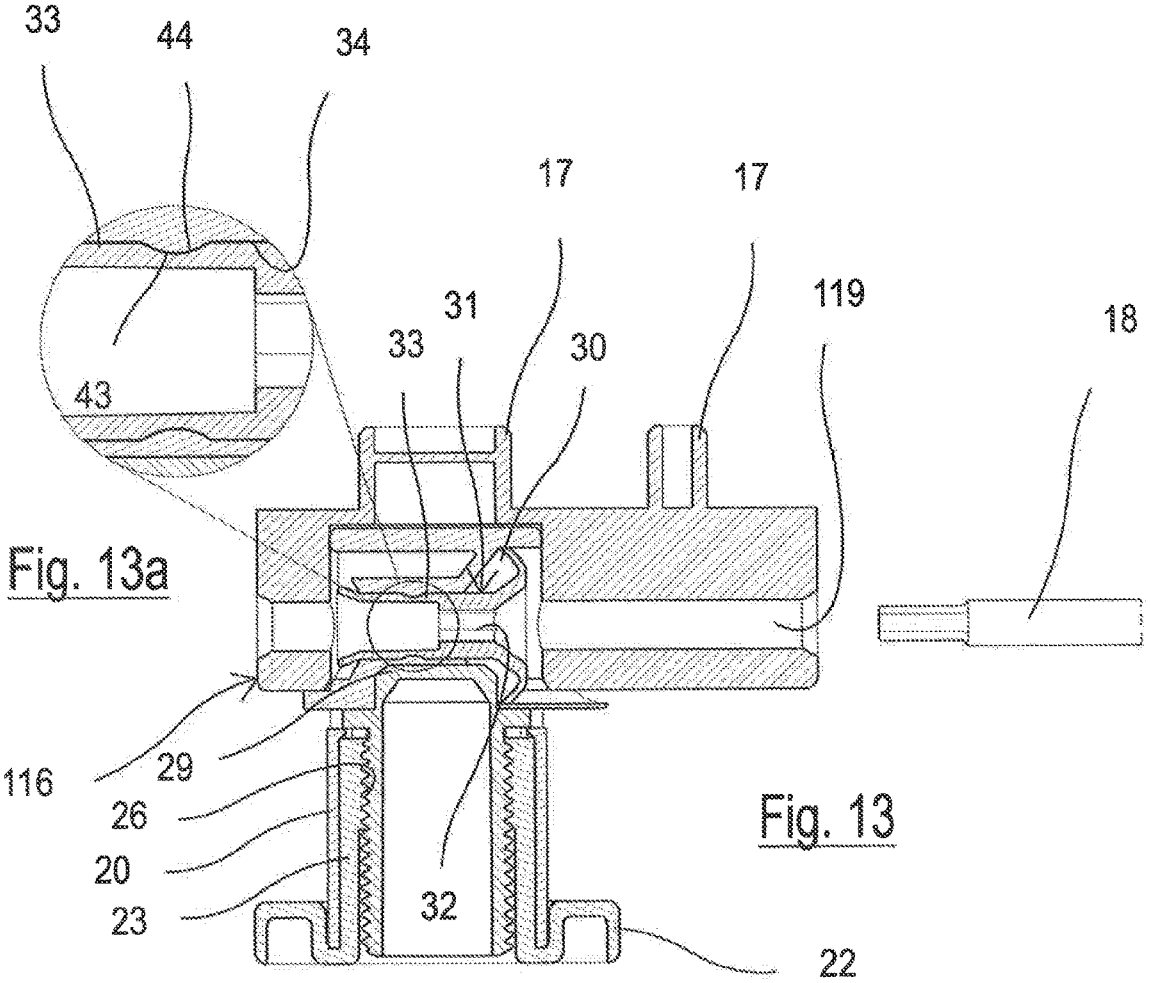
Fig. 13a
Fig. 13

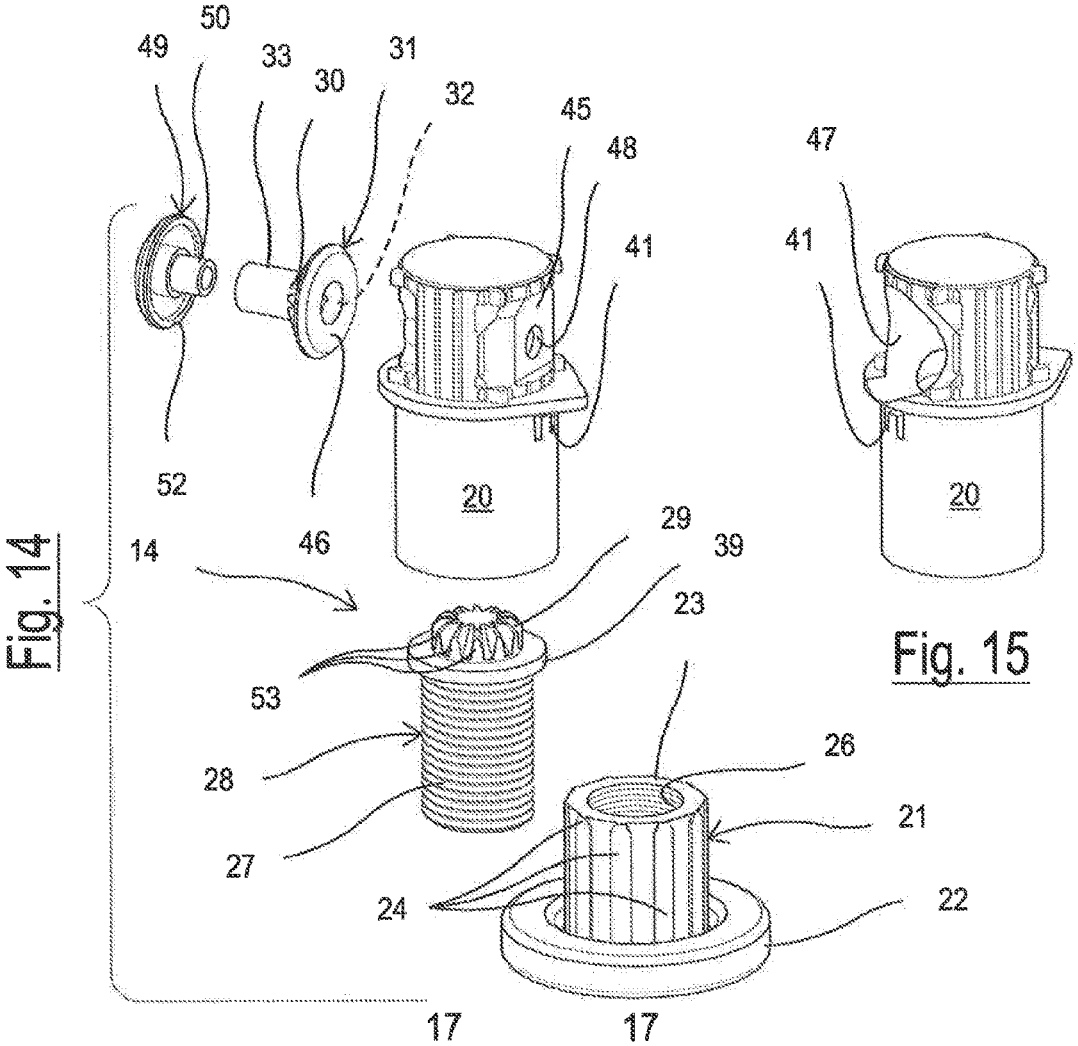
Fig. 14
Fig. 15
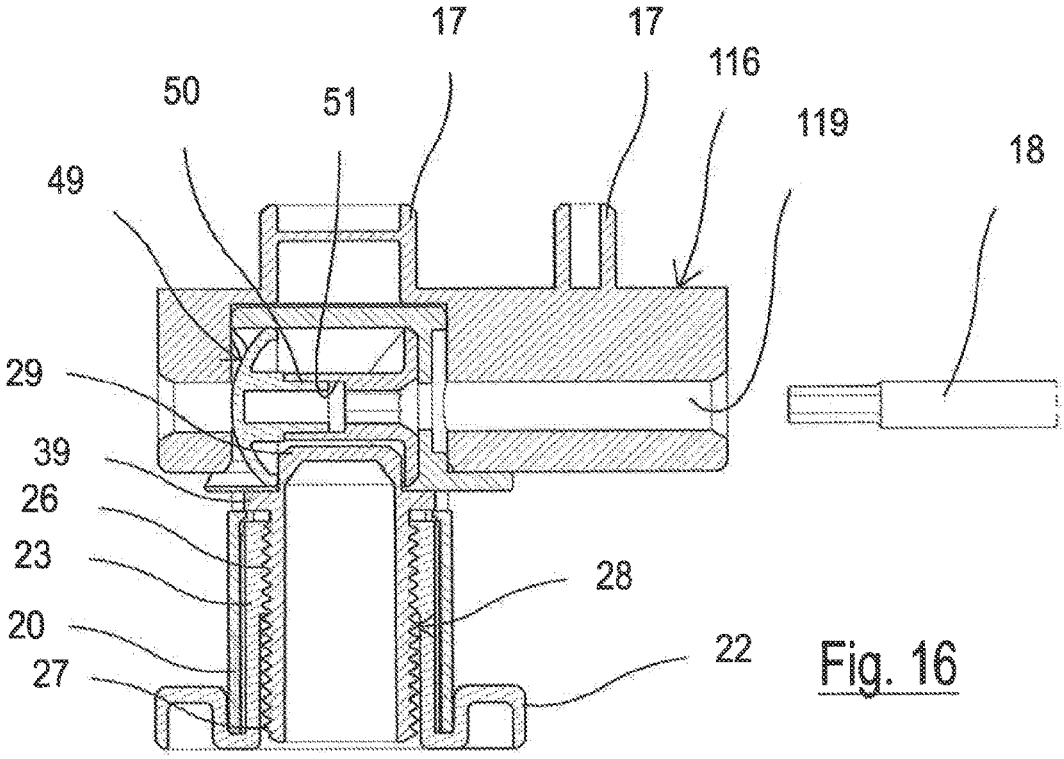
Fig. 16

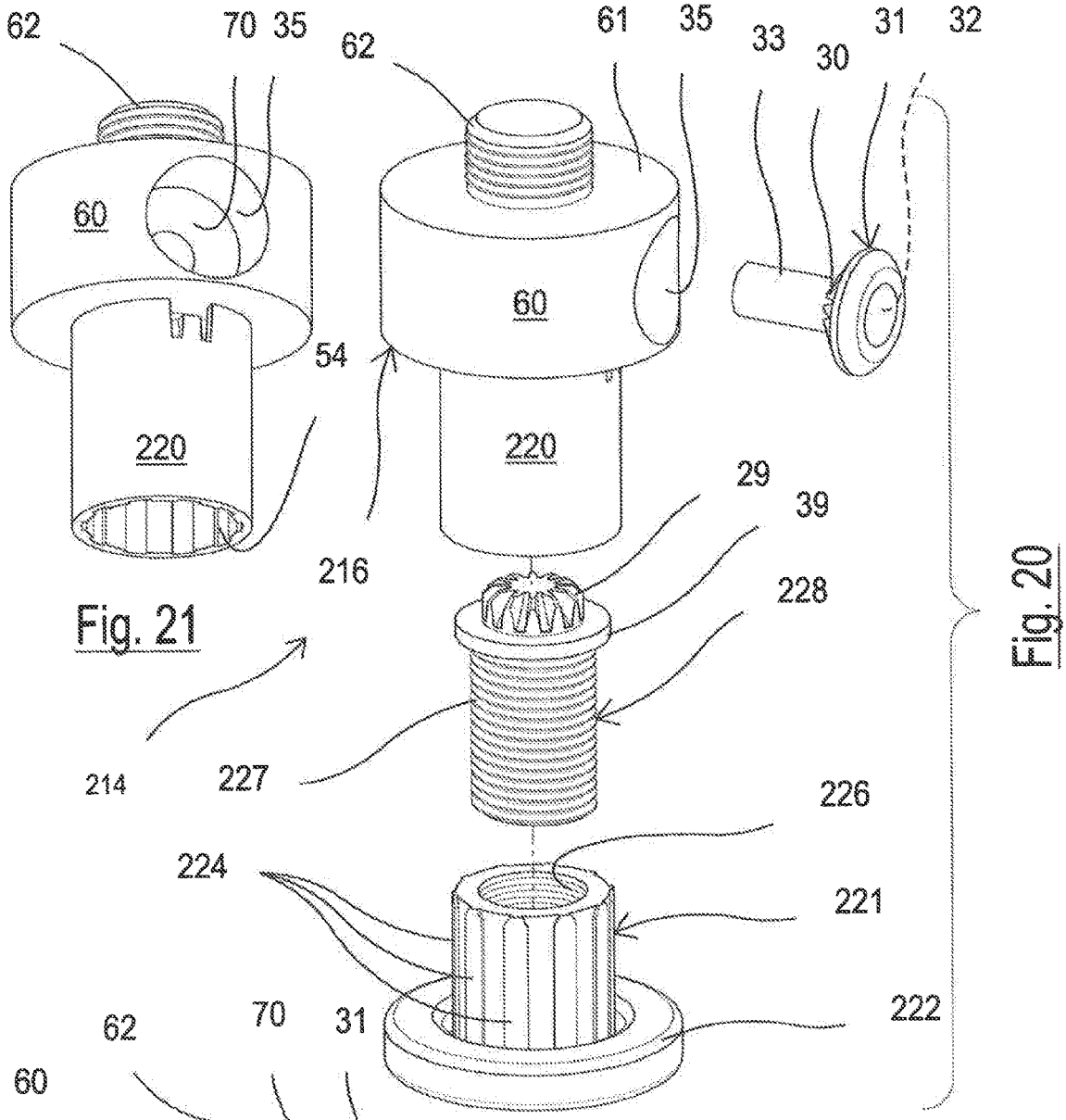
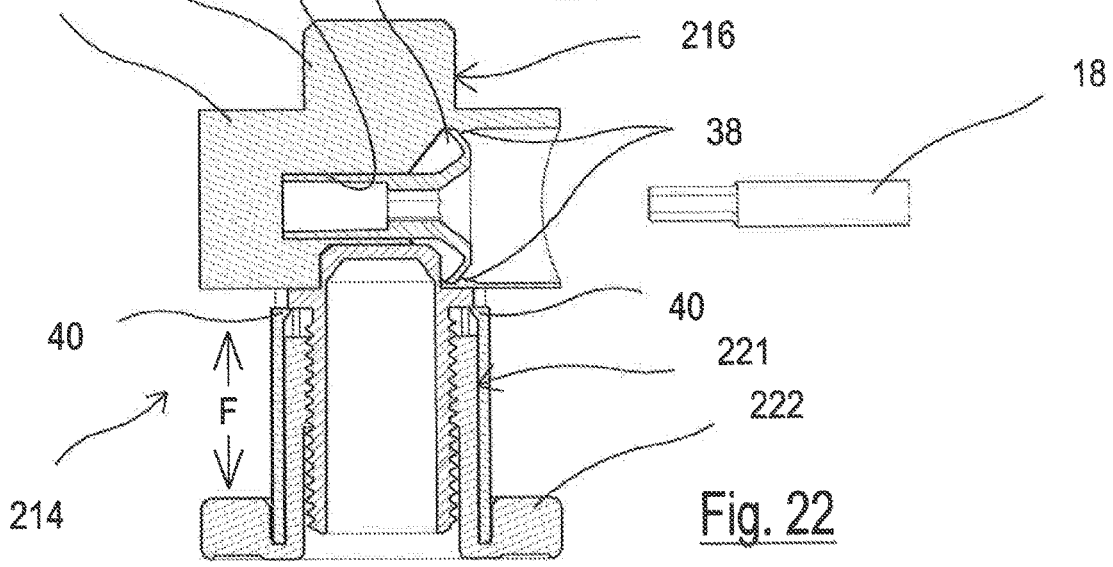
Fig. 22

Fig. 25
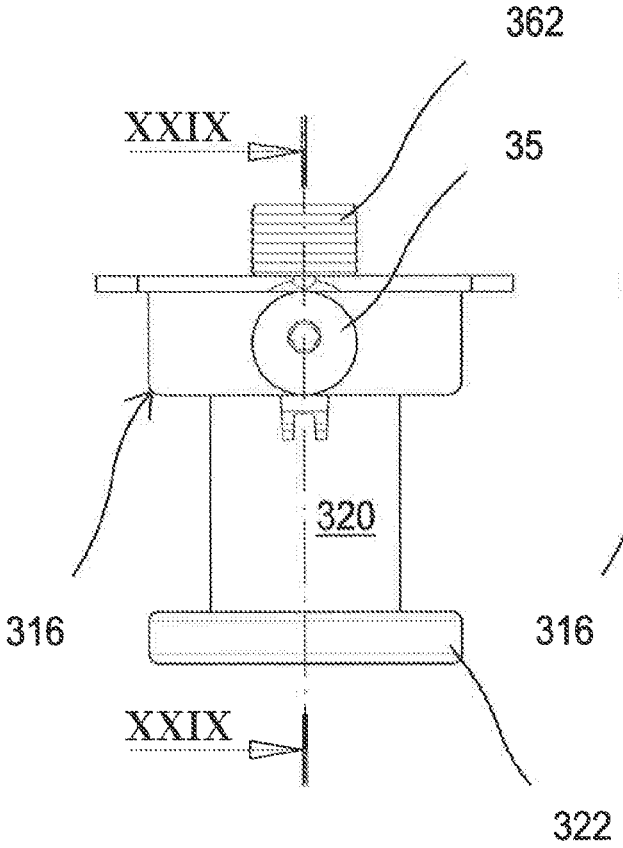
Fig. 26
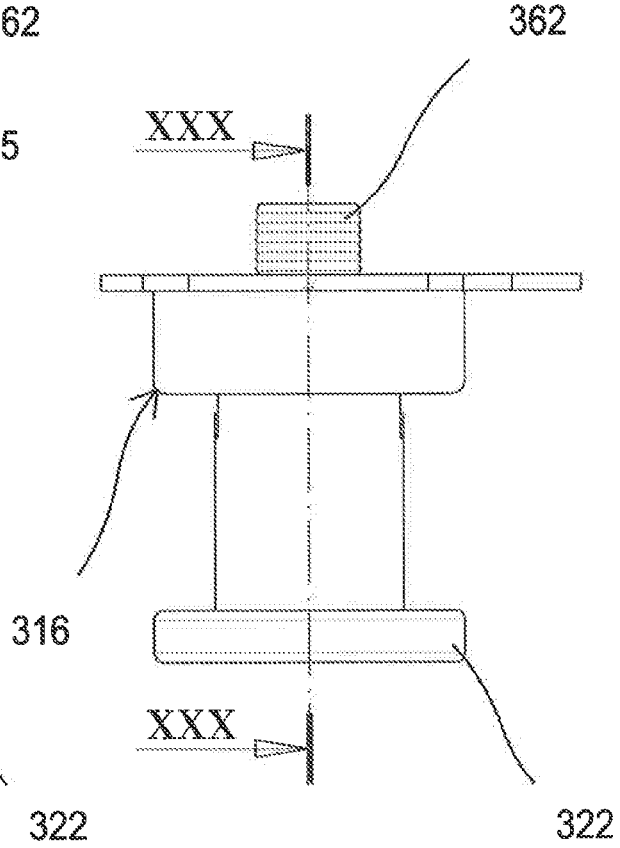
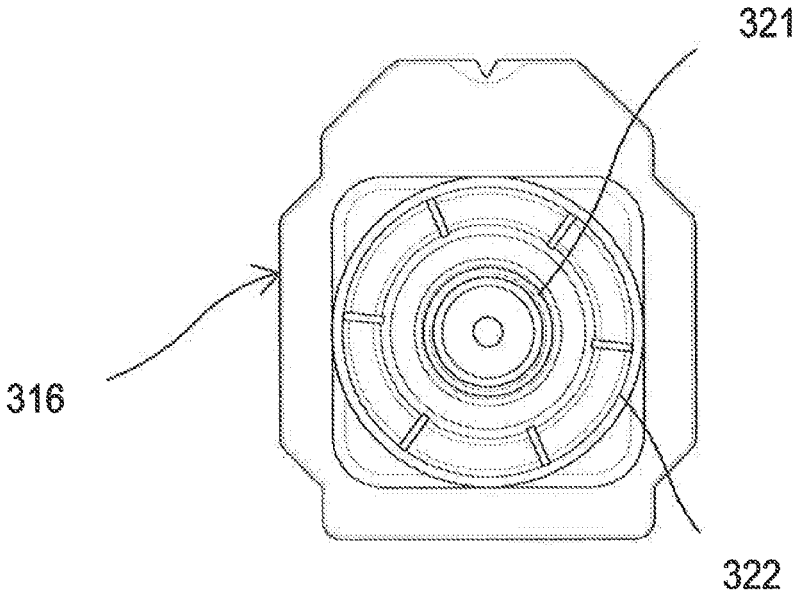
Fig. 27

Fig. 28
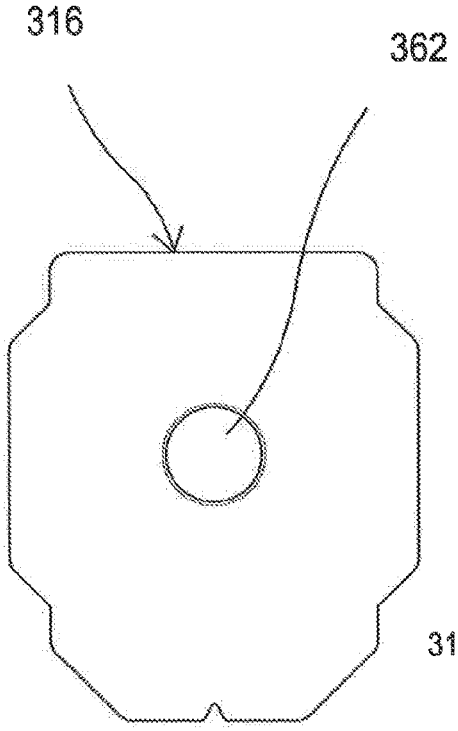
Fig. 29
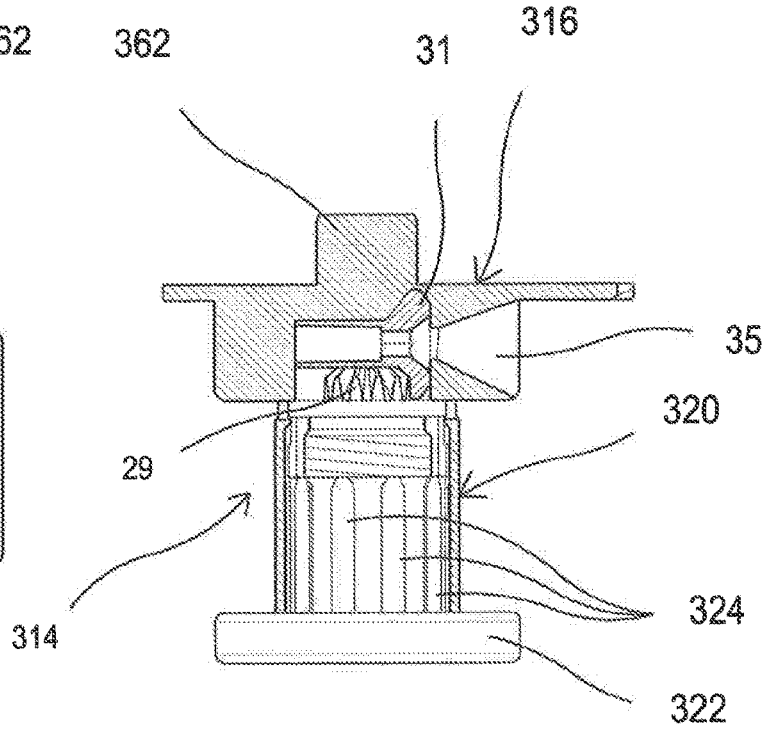
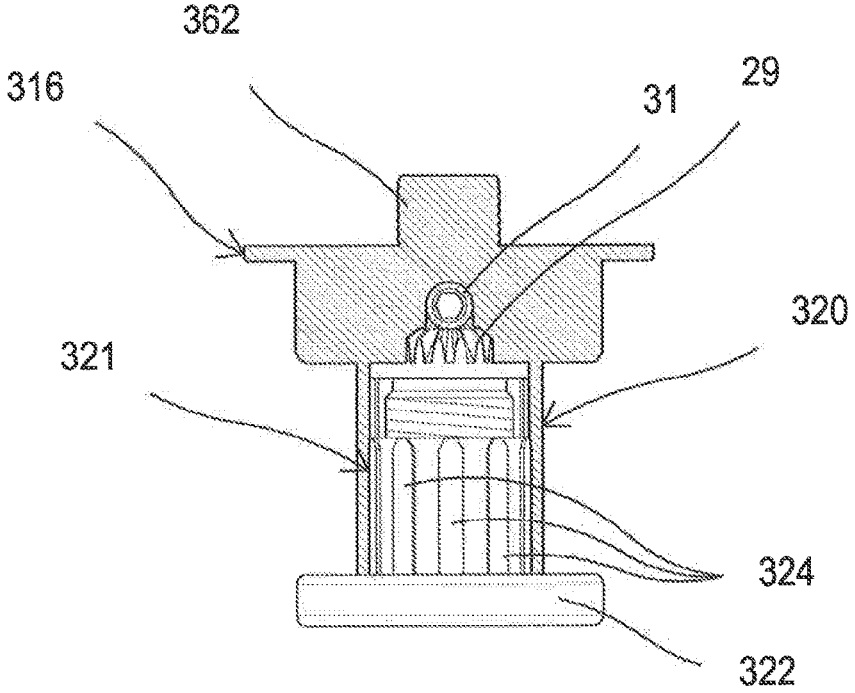
Fig. 30

TELESCOPIC FOOT FOR FURNITURE AND/OR FURNISHING ITEMS WITH SIMPLIFIED ASSEMBLY AND SYSTEM USING SAID FOOT

The present invention relates to a telescopic foot for furniture and/or furnishing items with simplified assembly and a system that uses this type of foot.

In the field of adjustable feet for furniture and similar furnishing items, a wide variety of feet can be provided. Adjustable telescopic feet are in fact used by the seller directly installed on the piece of furniture, but feet that can be installed and adjusted by the final customer or user of the furniture are also adopted, for example that can also be mounted like the furniture by the final customer.

In addition to the furniture provided with its accessories, such as the feet, directly mounted by specialized personnel of the manufacturer, there is also in fact furniture destined for being completely assembled by the customer. In this case, in addition to the structural components of the piece of furniture, accessories can also be supplied with their parts disassembled, to be composed by the customer. All of this in order to minimize the final costs of the product, eliminating assembly costs of these accessories.

There is in fact a market share of furniture manufacturers that sell furniture in disassembled kits with attached bags containing all the necessary hardware, delegating the assembly of the furniture to the final user. As already mentioned, in this way it is possible to keep the costs to a minimum and consequently apply much more advantageous sales prices of the furniture.

It is immediately evident that in these cases the low cost of the hardware that accompanies the furniture and the ease of assembly and use of the same by the consumer also play a fundamental role.

The general objective of the present invention is to provide a telescopic foot for furniture and/or furnishing items with simplified assembly and a system that uses this type of foot which is able to solve the above-mentioned drawbacks of the known art in an extremely simple, economical and particularly functional manner.

A further objective of the present invention is to provide an extremely simplified and rapid adjustable telescopic foot, within the reach of the direct purchaser and user of the furniture.

Another objective of the present invention is to provide an adjustable telescopic foot which can be produced in large quantities at a low cost and that can be mounted without the aid of particular tools.

Yet another objective of the present invention is to identify a system which uses an adjustable telescopic foot of this type at a reduced cost and also as a system that can be fitted by the final consumer.

The above-mentioned objectives are achieved by a foot with front adjustment and with simplified assembly and a system which uses a foot of this type produced according to the independent claim 1 and the following subordinate claims.

The structural and functional characteristics of the present invention and its advantages with respect to the known art will appear even more evident from the following description, referring to the attached schematic drawings, which show an embodiment example of the same invention. In the drawings:

FIG. 10 is a perspective view illustrating a second embodiment of a foot with a different way of positioning the pinion in the body of the foot, also with its parts exploded, produced according to the invention;

FIG. 11 is a raised sectional view of the foot of FIG. 10 when associated with a connection for a panel of a piece of furniture to be adjusted by a tool such as a screwdriver and FIG. 11*a* shows an enlarged detail of FIG. 11;

FIG. 12 is a perspective view illustrating a third embodiment of a foot with another different way of positioning the pinion in the body of the foot, with its parts exploded, produced according to the invention;

FIG. 13 is a raised sectional view of the foot of FIG. 12 when associated with a connection for a panel of a piece of furniture to be adjusted by a tool such as a screwdriver and FIG. 13*a* shows an enlarged detail of FIG. 13;

FIG. 14 is a perspective view illustrating a fourth embodiment of a foot with yet another different way of positioning the pinion in the body of the foot, with its parts exploded, produced according to the invention;

FIG. 15 is a perspective view from below of a body of the foot according to FIG. 14;

FIG. 16 is a raised sectional view of the foot of FIG. 14 when associated with a connection for a panel of a piece of furniture to be adjusted by a tool such as a screwdriver;

FIG. 20 is a perspective view which illustrates a further embodiment of a foot with an integrated connection with its parts exploded, produced according to the invention;

FIG. 21 is a perspective view from below of a body of the foot according to FIG. 20;

FIG. 22 is a raised sectional view of the foot of FIG. 20 assembled and in position to be adjusted by a tool such as a screwdriver;

FIGS. 25 and 26 are two raised side views which illustrate yet a further embodiment of a foot with an integrated connection produced according to the invention, rotated by 90° with respect to each other;

FIGS. 27 and 28 are two plan views from below and from above of the foot of FIGS. 25 and 26;

FIG. 29 is a raised sectional view of the foot of FIG. 25 according to the line XXIX-XXIX;

FIG. 30 is a raised sectional view of the foot of FIG. 26 according to the line XXX-XXX.

Figure 1:
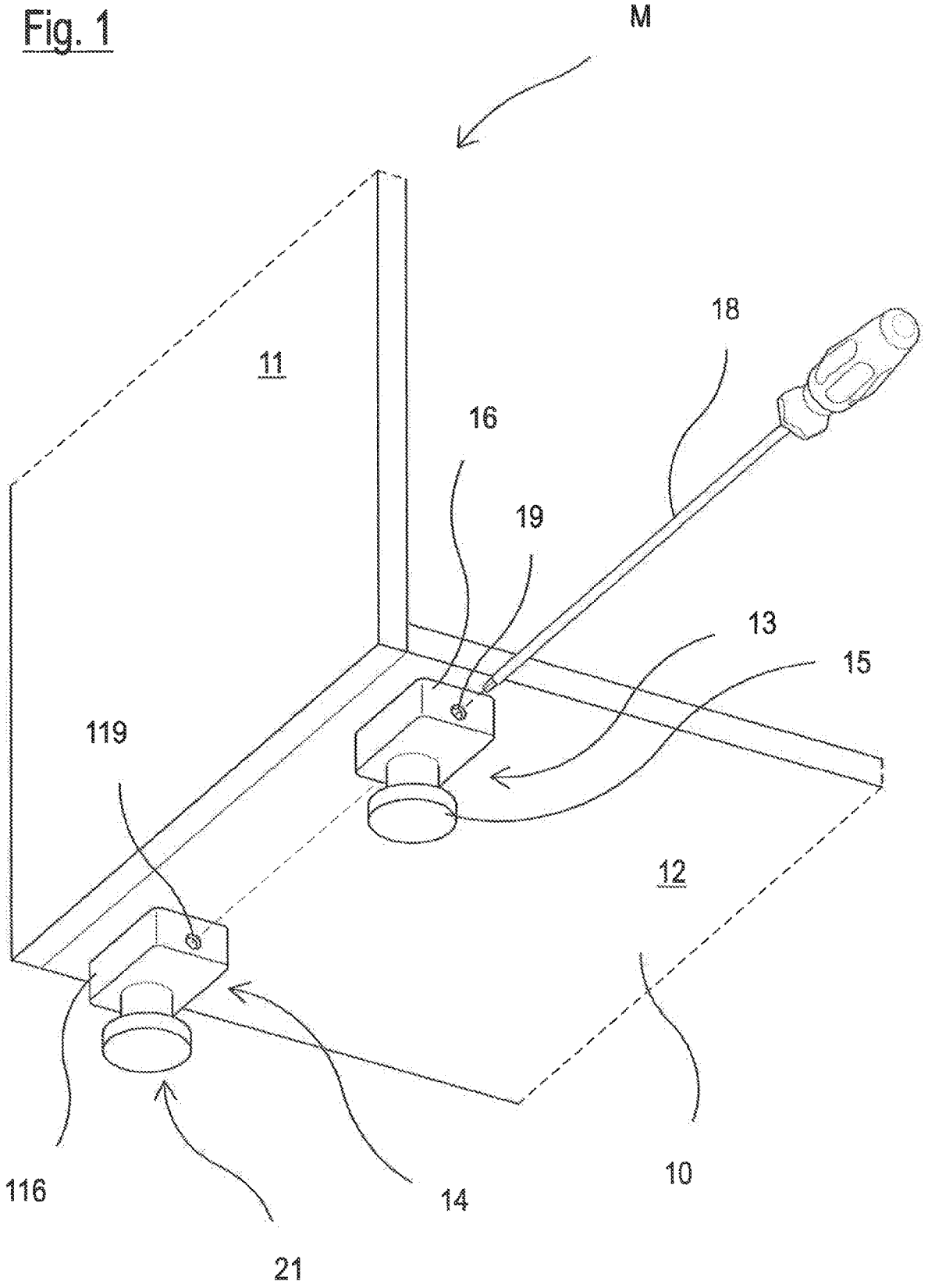
FIG. 1 is a perspective view from below showing a part of a piece of furniture to which a foot according to the invention can be applied.
Figures 2, 3, 4, 5:
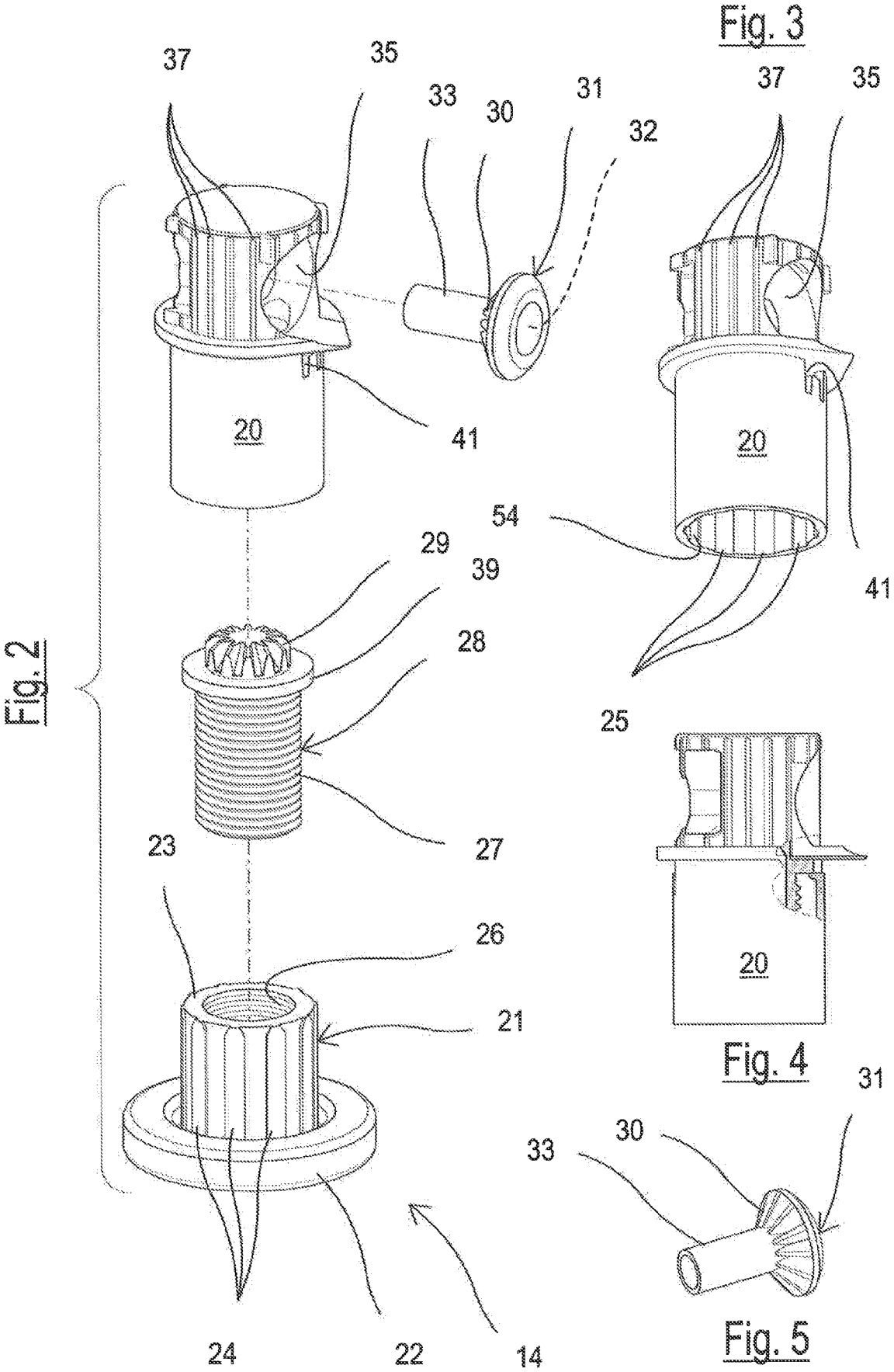
FIG. 2 is a perspective view illustrating a first embodiment of a foot with its parts exploded produced according to the invention.
FIGS. 3 and 4 are a perspective view from below and a raised side view, partially sectional, of a body of the foot according to FIG. 2.
FIG. 5 is a perspective view of a pinion part of the foot of FIG. 2.
Figure 6:
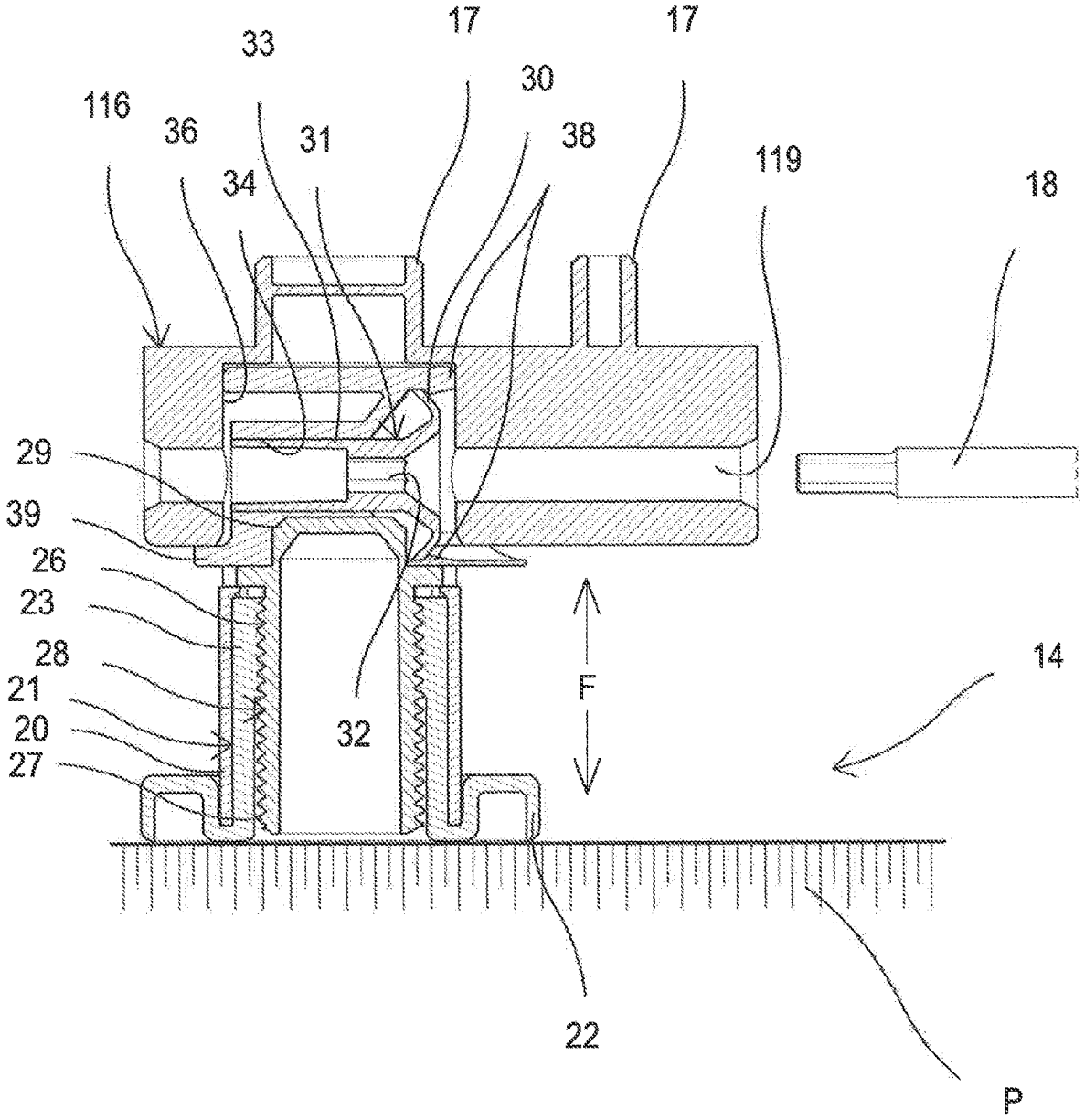
FIG. 6 is a raised sectional view of the foot of FIG. 2 when associated with a connection for a panel of a piece of furniture to be adjusted by a tool such as a screwdriver.

With reference to FIG. 1, a piece of furniture M is at least partly shown, which comprises a shoulder 11 associated with a bottom 12. The bottom 12 usually has two front feet 13 and two rear feet 14 applied to it (only a pair of these is shown). Alternatively or even simultaneously the feet of the present invention are also fixed to the shoulder 11.

In the example, the front feet 13 are of the type with manual adjustment by rotation of a supporting foot 15 with respect to a connection body 16 formed integral under a lower surface 17 of the bottom 12 of the furniture M.

The rear feet 14 are adjustable in the front of the furniture M from below the bottom 12, for example with a tip of a tool 18. The tip of the tool 18 is passed, for example, within a hole 19 passing through the connection body 16 of the front foot 13.

The following figures show in detail, in a first example, the possible conformation of the rear foot 14 of the invention and its structural simplicity, assembly and actuation.

In particular, as already stated, FIGS. 2 to 6 show a first embodiment of a telescopic rear foot for furniture and/or furnishing items with front adjustment produced according to the invention.

The rear telescopic foot 14 comprises a substantially cylindrical hollow body of the foot 20, which houses a supporting foot 21 in its interior. In this example, the supporting foot 21 has a lower end enlarged with a supporting disc 22 from which a hollow cylindrical portion 23 extends.

The cylindrical portion 23 is free to slide within this body of the foot 20 carrying a series of external grooves 24 on which they house a series of complementary internal grooves 25, the latter formed internally in the substantially cylindrical hollow body of the foot 20, in a lower part at one of its openings, indicated as a whole by 54. As can be seen further on in general, the supporting foot 21 is caused to slide telescopically in a lowering or lifting position with respect to the body of the foot 20 by means of an internal control mechanism or internal control mechanism or kinematic mechanism with respect to this opening 54 of the body of the foot 20.

In the example, the hollow cylindrical portion 23 of the supporting foot 21 provides an internal threading 26 suitable for receiving in coupling an external threading 27 provided on an inner cylindrical body 28. In a simplified view of the entire telescopic foot, the inner cylindrical body 28 can be considered part of the supporting foot 21.

In this way, a coupling is formed of the screw-and-nut type which creates an internal mechanism or kinematic mechanism.

The internal cylindrical body 28 at one of its upper free ends provides a conical toothed crown 29 which is suitable for being coupled with a complementary bevel toothing 30 of a pinion 31 arranged free to rotate in the body of the foot 20. In this way a transmission bevel gear is formed, for example at 90°, for controlling the rotation of the cylindrical body 28 within the hollow cylindrical portion 23 of the supporting foot 21.

It can therefore be noted that the above-mentioned internal control mechanism or kinematic mechanism is actuated by means of a transmission bevel gear 29, 30, 31 for controlling the rotation of the cylindrical body 28.

It should be pointed out that the presence of the external grooves 24 of the hollow cylindrical portion 23 of the supporting foot 21 in engagement with the internal complementary grooves 25 formed inside the body of the foot 20 allows the supporting foot 21 to slide with respect to the body of the foot 20, simultaneously preventing it from mutual rotation. In this way, it is possible to raise or lower the supporting foot 21 with respect to the body of the foot 20 and with respect to an underlying supporting plane P according to the arrow F, by acting on the bevel gear composed of the bevel toothed crown 29-bevel toothing 30 of the pinion 31.

The pinion 31 of the bevel gear is rotated by means of a tip of a tool 18 introduced into a seat 32 contained in a flaring formed therein. The seat 32 is suitable for receiving the tip of a tool for actuating the bevel gear. Furthermore, the pinion 31 provides a cylindrical end 33 which is inserted in a hole 34 arranged in an upper part of the body of the foot 20. This hole 34 is identified by means of a tubular portion arranged specifically in the upper part of the body of the foot 20.

The hole 34 has an axis X perpendicular to an axis Y of the body of the foot 20 and is aligned with a housing 35 or opening towards the outside. The housing 35 is in fact formed laterally outwardly as an opening in the body of the foot 20, in a direction parallel to the axis X, and contains the same pinion 31 free to rotate.

The body of the foot 20 with its relative supporting foot and internal cylindrical body 28, mounted therein and forming, in the example, the rear foot 14, are arranged within a housing 36 of a connection body 116 of the rear foot 14. For an appropriate reciprocal constraint, engagement grooves 37 can be provided both in the outer part of the upper part of the body of the foot 20 and inside the housing 36 of the connection body 116. In this way an alignment of a hole 119 is obtained, formed in the connection 116 to the seat 32 for the tip of a tool 18 provided in the pinion 31.

It should also be noted that both the connection body 16 of the front foot 13 and the connection body 116 of the rear foot 14 can be fixed below the lower surface 17 of the bottom 12 of the furniture M by means of fixing elements 37, such as dowels or snap engagement plugs or screws of any suitable type.

Figure 7:
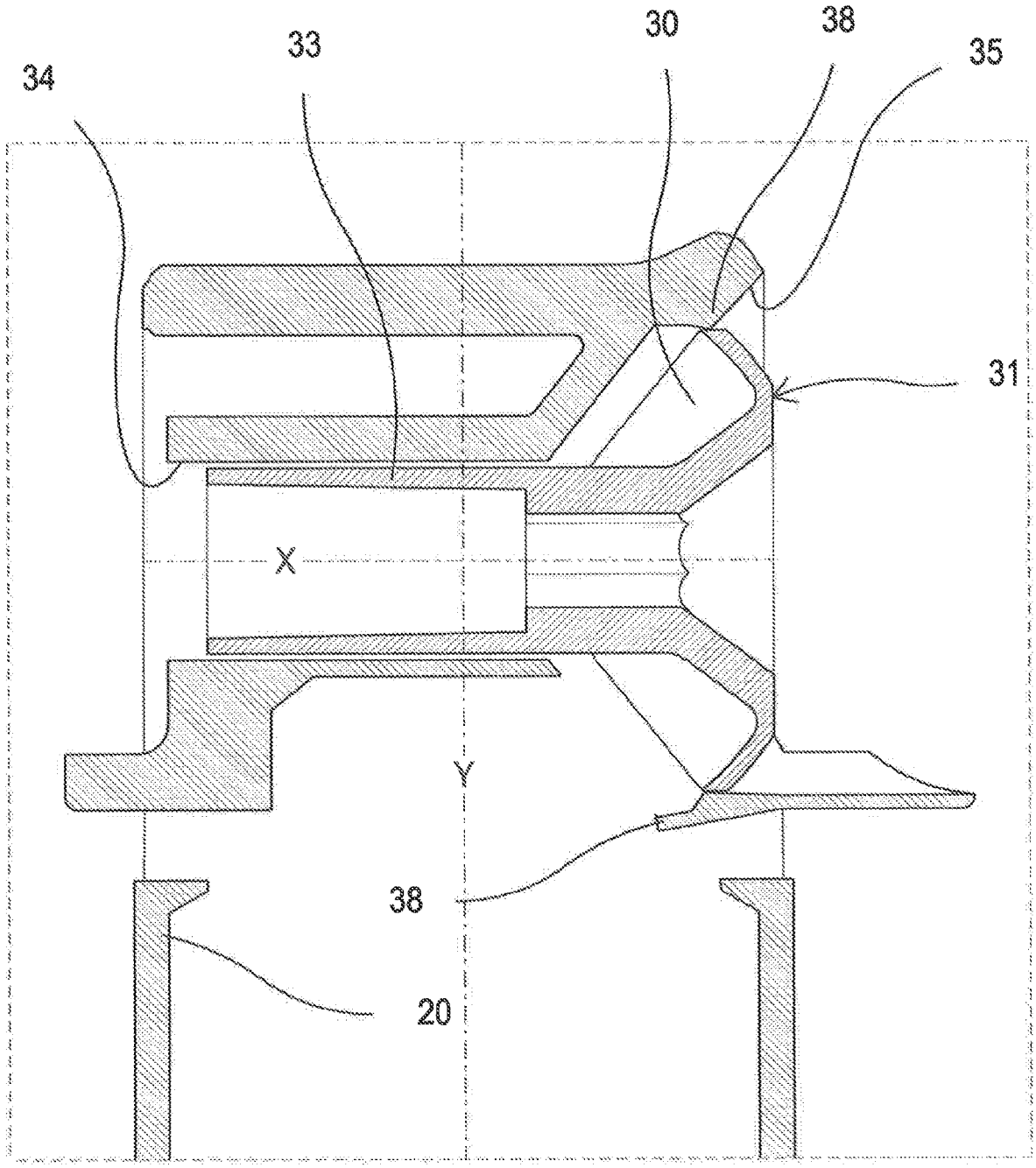
FIG. 7 is an enlarged sectional detail showing an assembly step in the body of the foot of a pinion part of the foot of FIG. 2.
Figure 8:
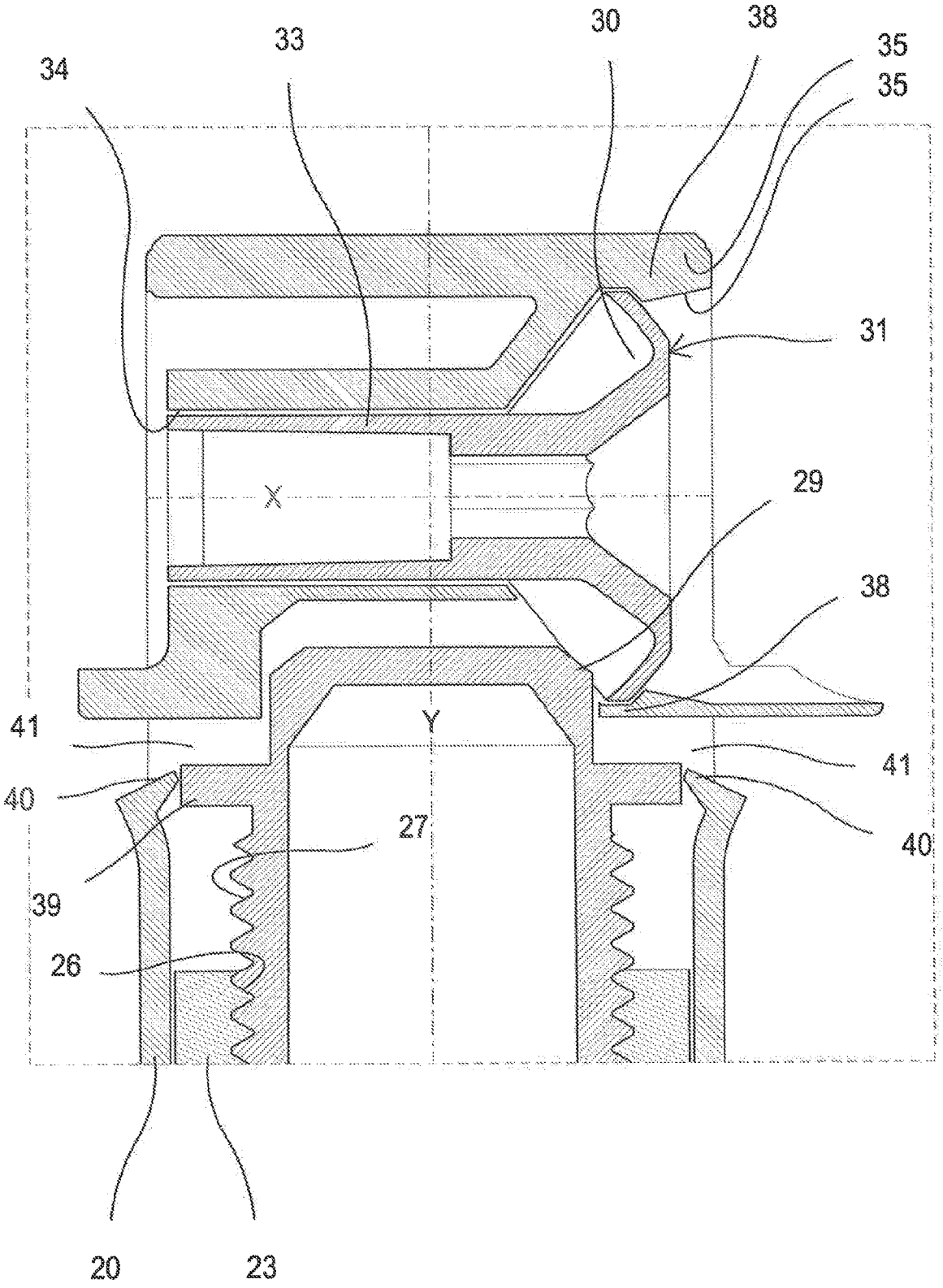
FIG. 8 shows the same enlarged sectional detail of FIG. 7 in a subsequent step in which a screw and a base plate previously screwed together are inserted.
Figure 9:
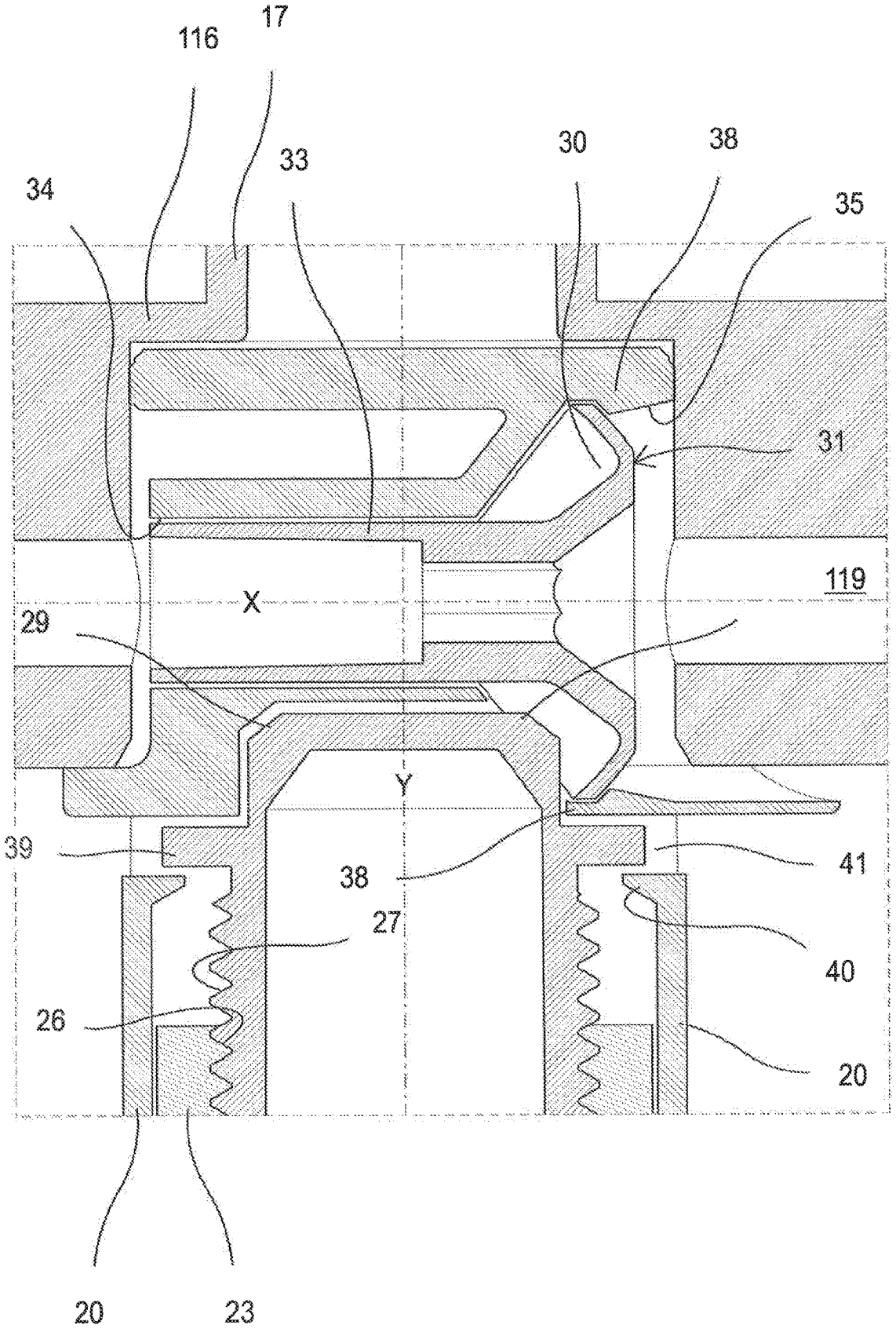
FIG. 9 shows the same enlarged sectional detail of FIG. 7 in a still further subsequent step in which the foot arranged as in FIG. 7 is inserted in a connection to be able to arrange it integral with a panel of a piece of furniture, such as a bottom.

FIGS. 7 to 9 show successive steps whereby the parts of the rear foot 14 described above in this first example are coupled and assembled.

FIG. 7, by means of an enlarged sectional detail, shows an assembly step in which the pinion 31 is inserted in the body 20 of the pin 14, having the bevel toothing 30 forming part of the bevel gear together with the bevel toothed crown 29.

Said FIG. 7 shows a first way of positioning the pinion 31 arranged free to rotate in the body of the foot 20.

For this purpose the cylindrical end 33 of the pinion 31 is inserted in the hole 34 provided in the upper part of the body of the foot 20. As already indicated, the hole 34 has an axis X perpendicular to an axis Y of the body of the foot 20 and is aligned with the housing 35, formed laterally outwardly in the body of the foot 20.

It can be seen that in this example the housing 35 in the body of the foot 20 provides perimetrically flexible flaps 38 which form elastic engagement means which, on yielding, allow the insertion of the pinion 31 in its operative position within the body of the foot 20.

These flexible flaps 38 are capable of yielding during the insertion of the pinion 31. Once the pinion 31 has been correctly inserted in the operative position, these yielding flaps 38 snap back into their initial position retaining the pinion 31 in an operative position ready for cooperating with the bevel toothed crown 29 of the inner cylindrical body 28. In this way elastic snap-engagement means are formed between the pinion 31 and the body of the foot 20.

Furthermore, the following FIG. 8 shows the same enlarged sectional detail of FIG. 7 in a subsequent step in which the inner cylindrical body 28 and the supporting foot 21 are inserted coupled together after being pre-screwed.

The internal cylindrical body 28 is in fact positioned first in the hollow cylindrical portion 23 of the supporting foot 21. This is achieved by screwing the external threading 27 of the inner cylindrical body 28 into the internal threading 26 of the hollow cylindrical portion 23 of the supporting foot 21.

The group of the supporting foot 21 thus formed is then inserted into the body of the foot 20 by coupling the series of external grooves 24 of the hollow cylindrical portion 23 inside the series of complementary internal grooves 25 formed within the body of the foot 20.

In order to obtain a stable blocking between the parts, a flange 39 is provided, formed in the internal cylindrical body 28 between a final end of the external threading 27 and the bevel toothed crown 29. Said flange 39 engages against further yielding flaps 40, formed protruding towards the interior in the body of the foot 20. These flaps 40 provide elastic engagement means which, on yielding, allow the insertion of the supporting foot 21 in its operative position within the body of the foot 20. In particular, these further flaps 40 then snap back into their initial rest position and are positioned in seats 41 formed laterally to the body of the foot 20, blocking the parts in the operative position.

It can therefore be seen that there are snap-engagement means between the supporting foot 21 and the hollow body of the foot 20.

In a further subsequent step, shown in FIG. 9 (which shows the same enlarged detail), it can be seen how the foot thus completed is inserted in a connection 116 to allow it to be arranged integrally with a panel of the furniture M.

FIG. 9 in particular shows how the complete foot assembly as seen in the previous FIG. 8 is inserted in the connection 116.

And this final step shows how, by a suitable reciprocal constraint between the parts, the engagement grooves 37 arranged on the upper external part of the body of the foot 20 are brought into engagement with a series of complementary engagement grooves provided inside the housing 36 of the connection body 116. In this example, yieldable flaps 38 and 40 have been shown for the engagement and retention between the parts of the rear foot, but other systems can be provided for effecting the rapid and simple constraint between the parts with an easy assembly operation.

It can thus be seen that both the first opening 35 and the second opening 54 provide elastic engagement and retaining elements of a respective element of said bevel gear 29,30,31.

In this respect, FIGS. 10, 11 and 11*a* show how in another way the pinion 31 can be stably positioned free to rotate in the upper part of the body of the foot 20 inside the hole 34. In the various figures, the same elements are indicated with the same reference numbers for the sake of simplicity.

This example, in fact, shows how a swaging or riveting can be provided in 42 of the cylindrical end 33 of the pinion 31, once the cylindrical end 33 has been inserted into the hole 34. The hole 34 is naturally defined by means of a tubular portion arranged as seen in the upper part of the body of the foot 20.

And furthermore, FIGS. 12, 13 and 13*a* show yet another way whereby the pinion 31 can be stably positioned free to rotate in the upper part of the body of the foot 20 inside the hole 34. Again for the sake of simplicity, the same elements are indicated with the same reference numbers.

In this further example the cylindrical end 33 of the pinion 31 provides a groove or recess 43 on its outer surface. Said groove or recess 43, when the cylindrical end 33 of the pinion 31 is inserted in the hole 34, arranged in the upper part of the body of the foot 20, is snap-engaged with a rounded protrusion 44 formed inside the hole 34. As seen above, this hole 34 is defined by a tubular portion arranged in the upper part of the body of the foot 20.

The above-mentioned engagement (groove or recess 43-rounded protrusion 44) creates a stable engagement between the parts with secure retention in the operative position of the pinion 31.

Furthermore, FIGS. 14, 15 and 16 show by means of yet another example, how the pinion 31 can be positioned stably in the upper part of the body of the foot 20. As for the previous examples, again the same elements are indicated with the same reference numbers.

In this example, the body of the foot 20 has a different form as the housing or opening 35 of the previous examples is replaced by a closing wall 45 of the opening 35 in which a hole is produced for the passage of a tip of a tool 18 for controlling the pinion 31 of the bevel gear.

The closing wall 45 also creates an abutment surface for a flat end 46 of the pinion 31 when this is introduced into a cavity formed in the upper part of the body of the foot 20. It can also be noted that the body of the foot 20 is hollowed to contain the above-mentioned pinion 31 free to rotate, introduced through an opening 47 facing the closing wall 45, said opening 47 being produced laterally in the body of the foot 20.

It should be pointed out that in this example there is also the addition of a cap element 49 provided with a shank 50 suitable for being inserted in a hole 51 inside the cylindrical end 33 of the pinion 31.

The cap element 49 provides a convex rounded dome-shaped head which favours the centering of the body of the foot 20 of the pinion 31 in the above-mentioned cavity, when coupled with the cap element 49. Furthermore, this coupling keeps the pinion 31 aligned with the hole 119 of the connection 116.

Furthermore, the presence of the bevel toothed crown 29 at the end of the inner cylindrical body 28 also cooperates in keeping the pinion 31 in position.

A flat annular crown 52 of the cap element 49 is abutted against flat facets 53 of the conical toothed crown 29 which can be moved in reciprocal engagement sliding one 53 on the other 52.

In this example, the assembly takes place first by forming a pinion 31-cap element 49 group by inserting the shank 50 of the cap element 49 in the hole 51 inside the pinion 31.

These two parts joined together are then positioned in the cavity of the body of the foot 20 by inserting them from the opening 47 which is formed laterally in the body of the foot 20. In this way, the flat end 46 of the pinion 31 is positioned against the inner surface of the closing wall 45.

In this way, it can be seen how, according to the present invention, a telescopic foot for furniture and/or furnishing items can be rapidly and easily assembled and within the reach of the final user.

Some of the ways are also shown of how the pinion 31 can be positioned in the body of the foot 20 which are particularly simple and easy to use.

Figure 19:
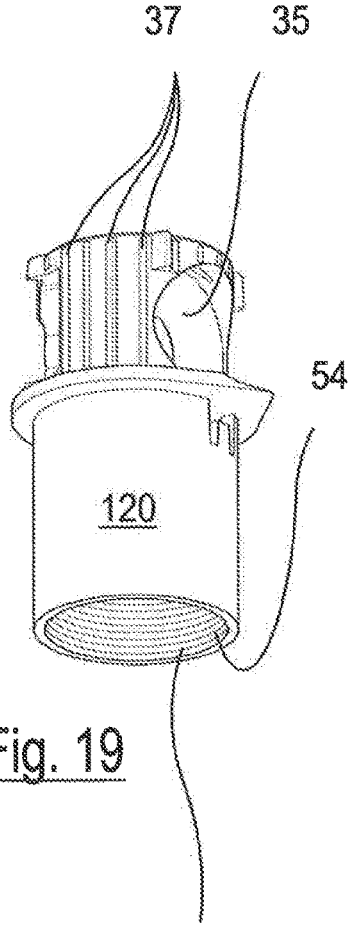
FIG. 19 is a perspective view from below of a body of the foot according to FIG. 18.
Figure 18:
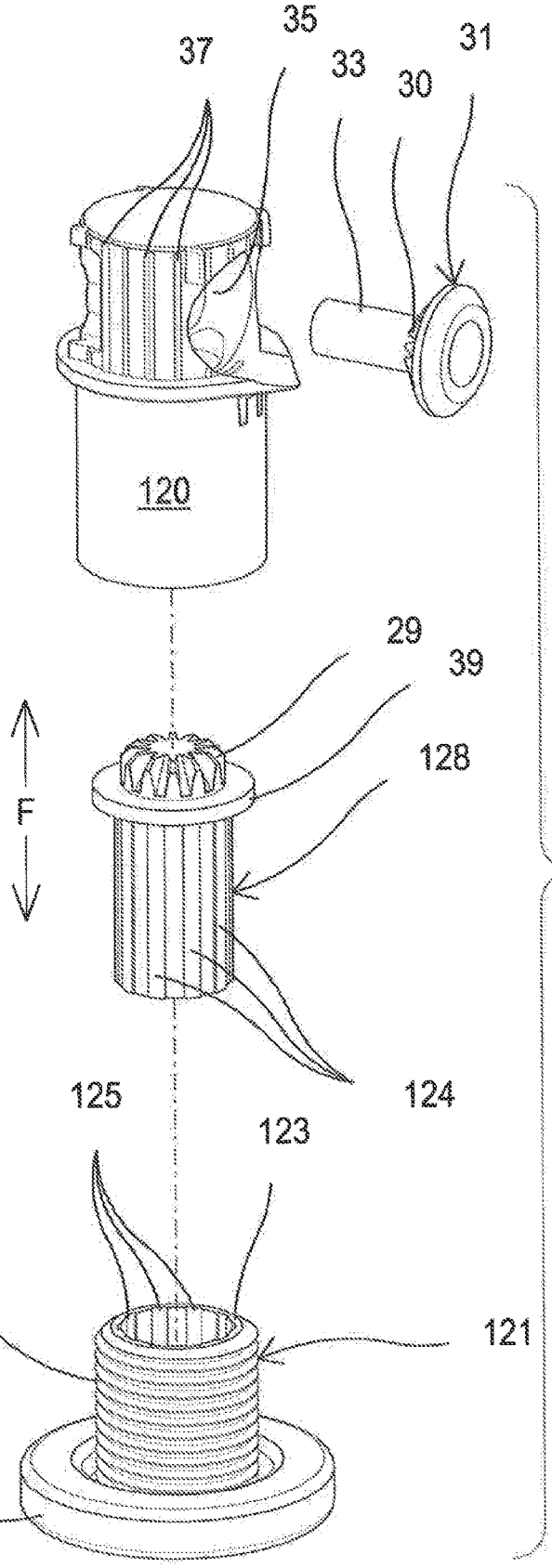
FIG. 18 is a perspective view illustrating a further embodiment of a foot with its parts exploded, produced according to the invention.

FIGS. 18 and 19 illustrate a further embodiment of a foot produced according to the invention in which the internal control mechanism or kinematic mechanism provides for a reversal of the coupling and cooperation elements between the parts. In these figures, functionally equal elements are indicated with the same numbers preceded by a "1" for the sake of simplicity.

It can be seen that a foot 114 comprises a body of the foot 120, also substantially cylindrical and hollow, which houses a supporting foot 121 in its interior.

Also in this example, the supporting foot from its lower supporting enlarged disc-shapes end 122 extends into a hollow cylindrical portion 123. In this case, the cylindrical portion 123 has an external threading 127 which can be screwed into a complementary threading 126 formed inside the hollow body of the foot 120. All in the place of the external grooves 124 and internal grooves 125 provided in the example of FIGS. 2 to 6.

Also in this case, the supporting foot 121 is caused to slide telescopically in a lowering or lifting position with respect to the body of the foot 120 by means of an internal control mechanism or kinematic mechanism.

Here, there is the provision, in fact, that the hollow cylindrical portion 123 of the supporting foot 121 has a series of internal grooves 125 suitable for receiving in coupling a series of external grooves 124 formed on the outer surface of an inner cylindrical body 128. In this way a grooved coupling is formed, that allows the sliding between the parts but not the mutual rotation.

The completion of the internal control mechanism or kinematic mechanism is achieved by virtue of the fact that the internal cylindrical body 128 has, at one of its upper free ends, a bevel toothed crown 29 which is suitable for being coupled with a complementary bevel toothing 30 of a pinion 31 arranged free to rotate in the body of the foot 120. In this way, a transmission bevel gear is produced, for example at 90°, for controlling the rotation of the cylindrical body 128 inside the body of the foot 120 and consequently enabling the sliding of the portion 123 of the supporting foot 121 with respect to the cylindrical body 128.

In this way there is an inversion between threaded coupling and grooved couplings.

Also in this case, the supporting foot 121 is raised or lowered with respect to the body of the foot 120 and with respect to an underlying supporting surface, according to the arrow F, when the parts are coupled with each other, acting on the bevel gear composed of the bevel toothed crown 29-bevel toothing 30 of the pinion 31.

Also in this case, the fixing of the pinion 31 in position can be carried out in the ways described above.

It can therefore be concluded that in these examples the telescopic foot for furniture and/or furnishing items of the invention provides that the internal control mechanism or kinematic mechanism is operated by means of a bevel gear 29, 30,31.

The control transmission bevel gear 29,30,31 is positioned between a first actuation opening 35 of said bevel gear and a second telescopically sliding opening of the supporting foot 21,121.

It can also be noted that both the first opening 35 and the second opening 54 are formed in the examples in the body of the foot 20,120. The first opening 35 is formed laterally and the second opening 54 is produced axially to the body of the foot 20,120 and they are arranged orthogonally with respect to each other to each receive an element of the bevel gear.

It can also be noted that in both cases means 24,25 and 124,125 are provided which allow the supporting foot 21,121 to slide with respect to the body of the foot 20,120 and at the same time prevent mutual rotation.

Furthermore, engagement and retention means 40 are provided between the supporting foot 21,121 and the hollow body of the foot 20,120.

In the examples described so far, a foot of the invention has been shown, which can be inserted into a connection 116 in turn fixed beneath a lower surface 17 of the bottom 12 of a piece of furniture M. Alternatively, however, the foot of the invention can have a connection integrated in the same as will be shown hereunder by some examples.

FIGS. 20 to 30 show what has just been specified.

In particular, FIGS. 20 to 22 will be examined first of all, wherein the same reference numerals are provided for the same elements. Furthermore functionally equal elements are indicated with the same numbers preceded by a "2" for the sake of simplicity.

It can be seen that a foot 214 comprises a body of the foot 220, here too substantially cylindrical and hollow, containing in its interior a supporting foot 221. Also in this example, the supporting foot extends from its lower end enlarged with a supporting disc 222 into a hollow cylindrical portion 223. The cylindrical portion 223 of the supporting foot 221 provides an internal threading 226 suitable for receiving in coupling an external threading 227 provided on an internal cylindrical body 228. In this way, a coupling of the screw-and-nut type is also formed.

The internal cylindrical body 228 at one of its upper free ends provides a bevel toothed crown 29 which is suitable for being coupled with a complementary bevel toothing 30 of a pinion 31 arranged free to rotate in an inner housing of the body of the foot 220. In this way, a transmission bevel gear is produced, for example at 90°, for controlling the rotation of the cylindrical body 228 within the hollow cylindrical portion 223 of the supporting foot 221. Again, the internal control mechanism or kinematic mechanism is actuated by the bevel gear 29,30,31.

Also in this example, external grooves 224 of the hollow cylindrical portion 223 of the supporting foot 221 are provided in engagement with complementary internal grooves 225 formed inside the body of the foot 220. This enables the supporting foot 221 to slide with respect to the body of the foot 220, at the same time preventing mutual rotation. This allows the supporting foot 221 to be raised or lowered with respect to the body of the foot 220, all acting on the bevel gear 29,30,31.

In this example a connection 216 is produced integral with the body of the foot 220 suitable for being fixed beneath a lower surface 17 of the bottom 12 or of the shoulder 11 of a piece of furniture M.

The connection 216 is defined by an enlarged disc-shaped element 60 in which the opening 35 is produced, through which the pinion 31 can be positioned and housed.

The disc element 60 extends as the upper part of the body of the foot 220 and a housing 70 is obtained therein for the pinion 31 arranged free to rotate. The disc element 60 has in its upper part, on one side 61, which is suitable for facing a lower surface 17 of the bottom 12 of the furniture dowel or expansion plug 62, or a pin with a knurled surface which presses into an unthreaded hole formed in the lower surface 17 of the bottom 12 or shoulder 11 of the furniture.

Alternatively, the connection 216 can naturally be of a different form than that of an enlarged disc-shaped element 60 and may comprise elements such as dowels, snap-engagement plugs or screws of any suitable type as a constraint or fixing to the bottom or shoulder of the piece of furniture.

Finally, FIGS. 23 to 30 will be examined, wherein the same reference numerals are provided for the same elements. Furthermore, functionally equal elements are indicated with the same numbers preceded by a "3" for the sake of simplicity.

In various parts, this example is similar to the previous one, but essentially provides that the pinion 31 be inserted from below rather than from the side as in the previous examples described and illustrated.

In this example, the pinion 31 is inserted from the opening 54 which is produced axially with respect to a body of the foot 320. Again, external grooves 324 are provided of the hollow cylindrical portion 323 of the supporting foot 321 in engagement with complementary internal grooves formed inside the body of the foot 320.

Here too, the pinion 31 is positioned in an inner housing 70 formed in a connection 316 which extends integral with the body of the foot 320. The internal housing 70 is naturally aligned with the opening 35.

Once the pinion 31 has been inserted in its housing 70, it is retained therein by positioning the supporting foot 321 in an operative position. It has previously been seen, in fact, that a flange 39 integral with an internal cylindrical body 28 engages against yieldable flaps 40, produced protruding inwardly in the body of the foot 320. These flaps 40 have been shown to provide elastic engagement means which, on yielding, allow the insertion of the supporting foot 321 in its operative position within the body of the foot 320 and in this case maintaining the position of the pinion 31.

This further example shows how a connection 316 can have a different form from that described for FIGS. 20,21 and 22, while retaining a dowel or expansion plug 62 above, which is suitable for being positioned in a non-threaded hole (not shown) produced in the lower surface 17 of the bottom 12 of a piece of furniture.

Figures 23, 24:
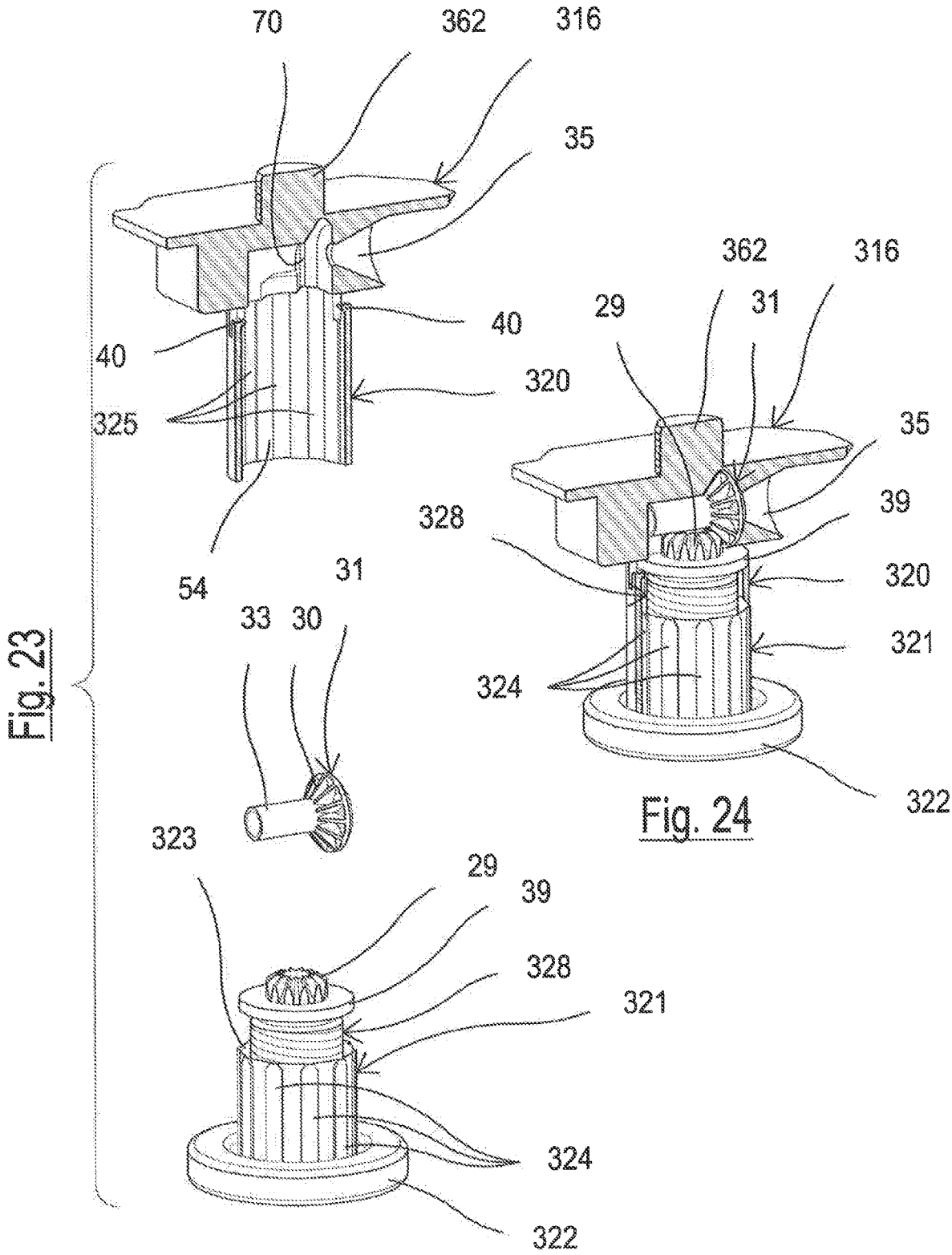
FIG. 23 is a perspective view, partially sectional, which illustrates yet another embodiment of a foot with an integrated connection with its parts exploded, produced according to the invention.
FIG. 24 is a perspective view of the foot according to FIG. 23 when assembled and partially sectional.

This example in FIG. 23 shows the particular assembly indicated above.

The pinion 31 is in fact first of all inserted according to the arrow K, introducing it into the body of the foot 320 from the opening 54 bringing it into the housing 70.

Then, in a subsequent step, the supporting foot 321 is inserted from the opening 54, coupling the external grooves 324 with the portion 323 containing the cylindrical body 328 in the grooves 325 inside the body of the foot 320.

This insertion continues until the flange 39 is positioned and blocked in a position withheld by the yielding flaps 40.

In this way the pinion 31 is automatically held in the correct operating position.

The provision of the above-mentioned expedients allows the production costs of the foot to be optimized to a maximum, also simplifying the assembly steps of the components.

Furthermore, as can be seen, the telescopic feet of the present invention are fixed to the bottom and/or fixed laterally to the shoulder of the furniture, unlike the known ones that are contained in the shoulder or shoulder-centre.

Figure 17:
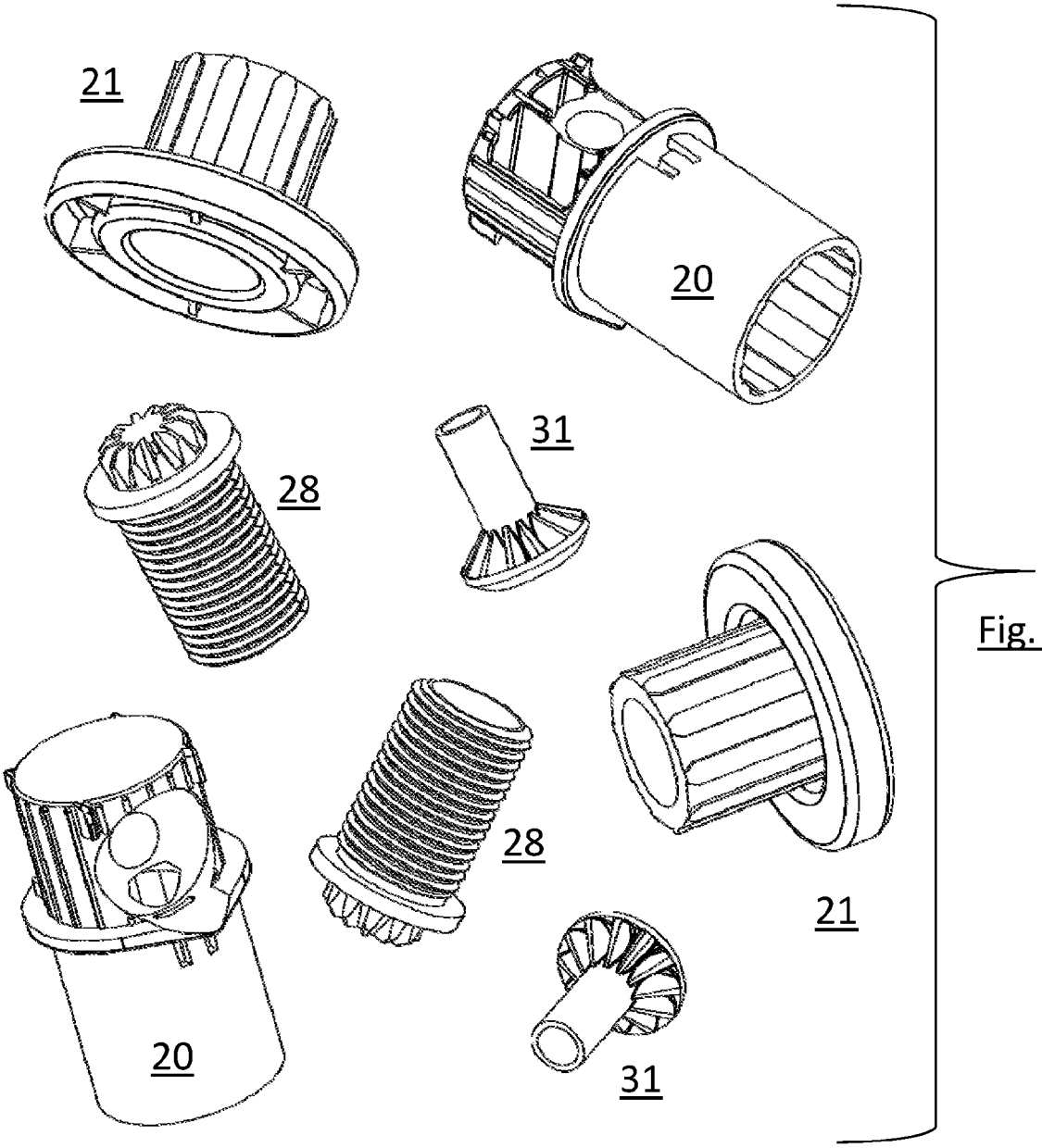
FIG. 17 is a perspective view showing parts of two feet arranged within a bag ready to be assembled and mounted under a bottom of a piece of furniture.

Everything is so simplified that the feet can be supplied in a bag 100, as shown in FIG. 17, to be supplied dismantled to the final customer and then easily put together and arranged on the furniture.

This allows a foot of this type to be also provided to furniture makers who sell furniture in disassembled kits with the necessary hardware bags attached.

All of this results in the fact that, by delegating the assembly of the furniture to the final consumer, it is possible to keep costs to a minimum and consequently apply particularly low and advantageous sales prices.

These feet with front adjustment and simplified assembly have been found to be particularly advantageous for being applied at the rear beneath a piece of furniture. This does not exclude that, given their low price, they can be used indiscriminately even for a front application.

This type of foot with front adjustment and simplified assembly is arranged at the rear when associated with a respective front foot of the type with manual adjustment by rotation of the supporting foot with respect to the connection body made integral underneath the bottom of the furniture M.

The invention therefore also allows a system to be identified which uses at least one front foot of the type with manual adjustment and at least one rear foot with front adjustment and simplified assembly according to the present invention, both arranged by means of connection bodies produced underneath the bottom of the furniture.

The forms of the structure for producing a foot with front adjustment and simplified assembly and a system using this type of foot of the invention, as also the materials and assembly modes, can obviously differ from those shown by way of non-limiting example in the drawings.

The objective mentioned in the preamble of the description has thus been achieved.

The protection scope of the present invention is defined by the enclosed claims.

The invention claimed is:

1. A telescopic foot for furniture and furnishing items comprising:

a hollow body of the telescopic foot; and a supporting foot housed in the hollow body and designed for a telescopic sliding in a lowering or lifting position with respect to said hollow body by way of an internal control mechanism or kinematic mechanism;

a control transmission bevel gear actuating said internal control mechanism or kinematic mechanism, said bevel gear being positioned between a first actuation opening of said bevel gear and a second telescopically sliding opening of said supporting foot, said first actuation opening and second telescopically sliding opening being formed in said hollow body, one in lateral and the other one in axial position in the hollow body and orthogonally to each other to each receive an element of said bevel gear; and sliding elements which allow the telescopic sliding of the supporting foot with respect to the hollow body, said telescopic foot further comprising an inner cylindrical body interposed between said hollow body of the foot and said supporting foot, said bevel gear comprising a bevel toothed crown integral with a free end of said inner cylindrical body, said bevel gear further comprising a flange which engages against yielding flaps protruding inwardly into the body of the telescopic foot, said yielding flaps forming engagement and retention elements configured to retain said supporting foot to said hollow body.

2. The telescopic foot according to claim 1, characterized in that said engagement and retention elements are elastic.

3. The telescopic foot according to claim 1, wherein said first actuation opening and said second telescopically sliding opening provide the engagement and retention elements, which are elastic, of a respective element of said bevel gear.

4. The telescopic foot according to claim 1, wherein the telescopic foot is adapted to be fixed beneath a bottom or to a shoulder of a piece of furniture.

5. The telescopic foot according to claim 1, wherein the sliding elements simultaneously prevent a mutual rotation of the supporting foot with respect to the hollow body.

6. The telescopic foot according to claim 1, wherein said bevel gear comprises said bevel toothed crown integral with the free end of the inner cylindrical body and a complementary bevel toothing of a pinion, and wherein said pinion is arranged free to rotate in said hollow body and provides a seat configured to receive a tip of a tool for actuating the bevel gear.

7. The telescopic foot according to claim 6, wherein said pinion is arranged free to rotate in said hollow body through snap-engagement elements between said pinion and said body.

8. The telescopic foot according to claim 7, wherein said snap-engagement are yielding flaps, which extend into a housing formed in the body of the telescopic foot.

9. The telescopic foot according to claim 6, wherein said pinion is arranged free to rotate in said hollow body through a swaging or riveting obtained at a free cylindrical end of the pinion, after said free cylindrical end has been inserted in a hole defined by a tubular portion arranged in an upper part of the hollow body.

10. The telescopic foot according to claim 6, wherein said pinion is arranged free to rotate in said body of the hollow foot with a groove or recess formed in a free cylindrical end of the pinion, after said free cylindrical end has been inserted in a hole defined by a tabular portion arranged in an upper part of the hollow body, to be coupled with a rounded protrusion formed inside the hole.

11. The telescopic foot according to claim 6, wherein said pinion is arranged free to rotate in said hollow body and provides a cylindrical end, with which a cap element, provided with a rounded dome-shaped head, is made integral, so as to favor a centering of said pinion coupled with said cap element in a cavity formed in said hollow body.

12. The telescopic foot according to claim 11, wherein said cavity provides, on one side, a closing wall in which a hole is formed configured for passage of said tip of the tool of the pinion of the bevel gear and, on another side, an opening facing the closing wall and formed laterally in the hollow body.

13. The telescopic foot according to claim 11, wherein said cap element is provided with a shank configured for being inserted in a hole inside said cylindrical end of the pinion.

14. The telescopic foot according to claim 11, wherein said cap element provides a flat annular crown, which is abutted against flat facets of the bevel crown, which can be moved in engagement with said flat annular crown.

15. The telescopic foot according to claim 1, wherein said internal control mechanism or kinematic mechanism comprises an internal threading formed in said supporting foot and configured to receive in coupling an external threading provided on said inner cylindrical body.

16. The telescopic foot according to claim 15, wherein said supporting foot comprises a lower supporting enlarged disc-shaped end, from which a hollow cylindrical portion extends, where said internal threading is formed.

17. The telescopic foot according claim 15, wherein said flange is formed between a final end of said external threading and the bevel toothed crown of said bevel gear.

18. The telescopic foot according to claim 17, wherein said yielding flaps are arranged within seats formed laterally with respect to the hollow body.

19. The telescopic foot according to claim 1, wherein said hollow body externally provides engagement grooves with a housing adapted to receive a connection body to a piece of furniture.

20. The telescopic foot according to claim 4, wherein said hollow body is integrated with a connection body adapted to be fixed beneath a bottom or a shoulder of a piece of furniture.

21. The telescopic foot according to claim 20, wherein said connection body is defined by an enlarged disc-shaped element in which said first actuation opening is formed, through which a pinion of said control transmission bevel gear can be positioned and housed.

22. The telescopic foot according to claim 21, wherein said enlarged disc-shaped element extends as an upper part of the hollow body and a housing for said pinion is formed therein, which is free to rotate, said disc-shaped element having in an upper part, on one side, which is configured to face a lower surface of the bottom of the piece of furniture, a dowel or expansion pin, which is adapted to press into an unthreaded hole formed in said lower surface of the piece of furniture.

23. A system adapted to be positioned beneath a bottom or a shoulder of a piece of furniture comprising:

at least one front foot, and at least one telescopic foot according to claim 1 adapted to be affixed beneath said bottom or to said shoulder.

24. The system according to claim 23, wherein said at least one front foot is of a manual adjustment type by rotation of a supporting foot.

25. The system according to claim 23, further comprising at least a first connection for the at least one front foot and at least a second connection for the telescopic foot disposed rearwardly, the at least one first and the at least one second connections being adapted to be disposed beneath the bottom of the piece of furniture, the at least one second connection being adjustable from a front through a tip of a tool.

* * * * *